US006070699A

United States Patent [19]

Bleeker

[11] Patent Number: 6,070,699

[45] Date of Patent: Jun. 6, 2000

[54] HYDRAULIC PLATFORM LIFT, ESPECIALLY FOR MOTORCYCLES

[75] Inventor: Gerardus Bleeker, Magdeburg, Germany

[73] Assignee: Grip GmbH, Oldenburg, Germany

[21] Appl. No.: 08/930,185

[22] PCT Filed: Apr. 3, 1996

[86] PCT No.: PCT/DE96/00633

§ 371 Date: Feb. 11, 1998

§ 102(e) Date: Feb. 11, 1998

[87] PCT Pub. No.: WO96/31321

PCT Pub. Date: Oct. 10, 1996

[30] Foreign Application Priority Data

Apr. 5, 1995 [DE] Germany ..... 295 05 521 U

[51] Int. Cl.[7] ..... B66B 9/16

[52] U.S. Cl. ..... 187/240; 187/211; 187/269; 254/10 C

[58] Field of Search ..... 187/211, 269, 187/240, 242; 254/8 R, 2 C, 8 C, 10 C

[56] References Cited

U.S. PATENT DOCUMENTS

| | | | |
|---|---|---|---|
| 2,922,533 | 1/1960 | La Barge, Jr. | 187/211 |
| 3,214,136 | 10/1965 | Marks | 254/10 C |
| 4,447,042 | 5/1984 | Masui | 187/204 |
| 5,040,637 | 8/1991 | Hawk | 187/211 |

FOREIGN PATENT DOCUMENTS

| | | | |
|---|---|---|---|
| 131194 | 6/1947 | Australia | 187/211 |
| 751843 | 9/1993 | France | 187/211 |
| 600595 | 7/1934 | Germany | 187/211 |
| 1944728 | 4/1970 | Germany | 187/211 |
| 324066 | 4/1936 | Italy | 187/211 |
| 297907 | 10/1936 | Italy | 187/211 |
| 462473 | 11/1951 | Italy | 187/211 |
| 505840 | 1/1957 | Italy | 187/211 |
| 911133 | 11/1962 | United Kingdom | 187/211 |
| 978921 | 1/1965 | United Kingdom | 187/211 |

*Primary Examiner*—Robert P. Olszewski
*Assistant Examiner*—Thuy V. Tran
*Attorney, Agent, or Firm*—Flanagan & Flanagan; John R. Flanagan; John K. Flanagan

[57] ABSTRACT

The present invention relates to a hydraulic platform lift, in particular a motorcycle platform lift, comprising a parallelogram chassis in which on one of the two parallel lifting arms a hydraulic cylinder, supported on the sub-frame, is articulated. The task of the invention is providing such a platform lift which has a substantially better intrinsic weight/lifting-force ratio than the comparable platform lifts known from prior art. This task is solved according to the invention by means of a platform lift of the above cited type thereby that the hydraulic cylinder (1) engages the lifting arm (4) at an articulation point (8) beneath the pivot axis (7) which for this purpose comprises in this region a projection (9) directed downwardly in order to make available a favorable lever arm (15) for the force transmission of the hydraulic cylinder (1), and that a tie (5) is provided connecting the support point (2) of the hydraulic cylinder (1) on the sub-frame (3) with the lifting arm (4), the articulation point (6) of which on the lifting arm (4) is coaxial with its pivot axis (7).

16 Claims, 5 Drawing Sheets

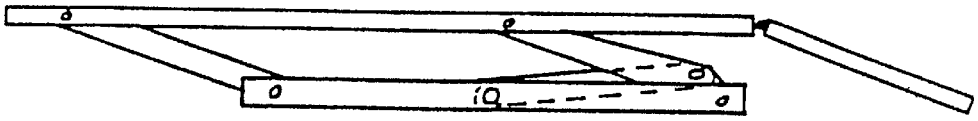
Fig. 2.1
(PRIOR ART)
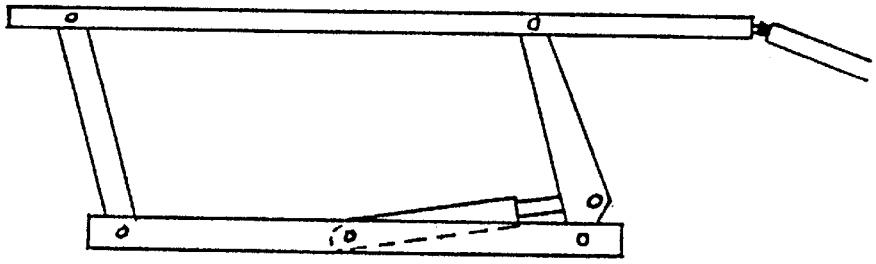
Fig. 2.2
(PRIOR ART)
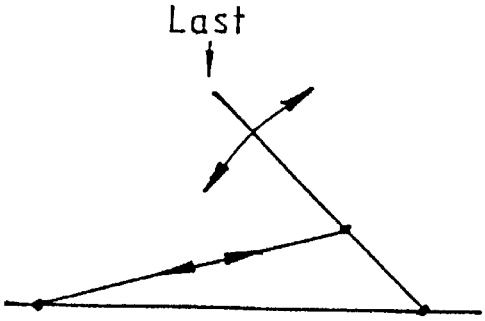
Fig. 2.3
(PRIOR ART)

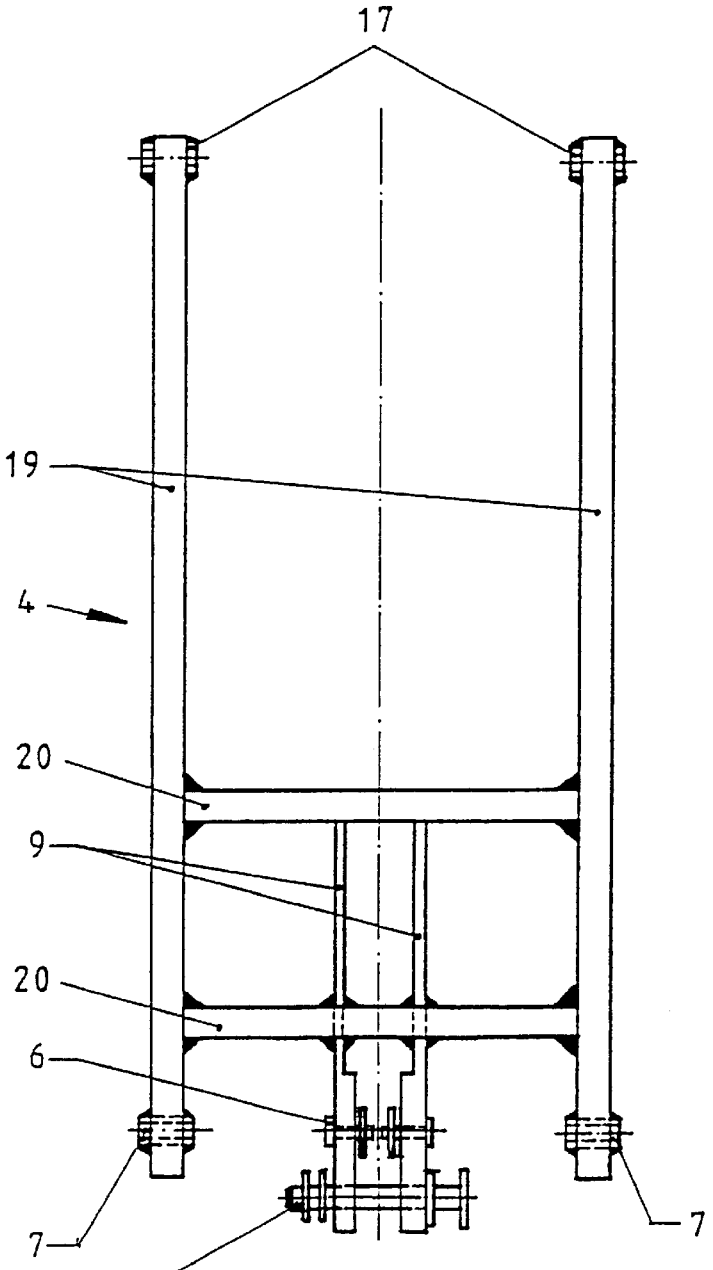
Fig. 6.1
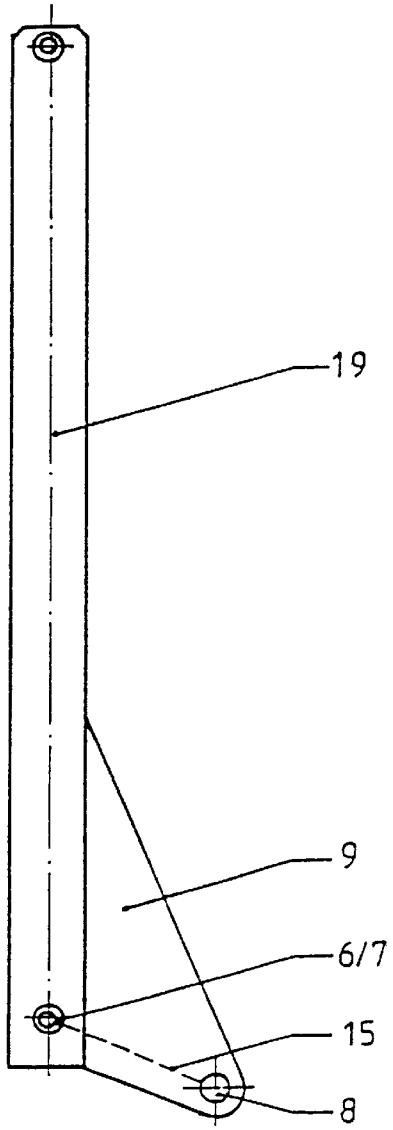
Fig. 6.2

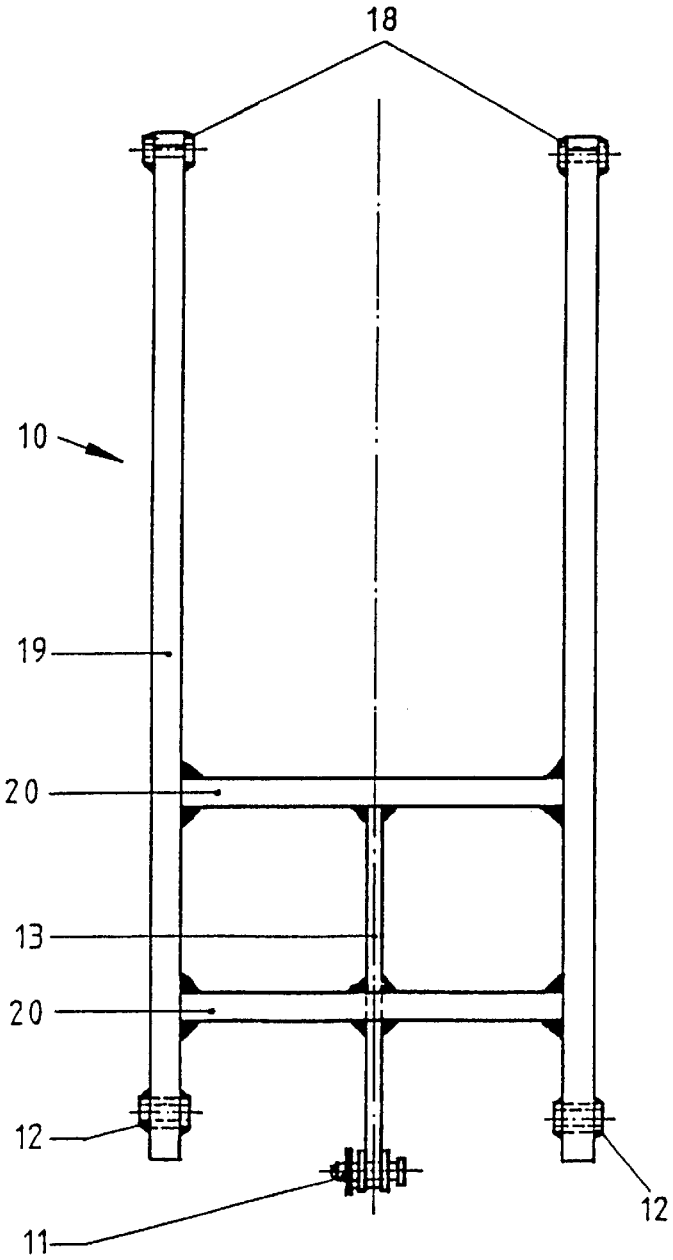
Fig. 7.1
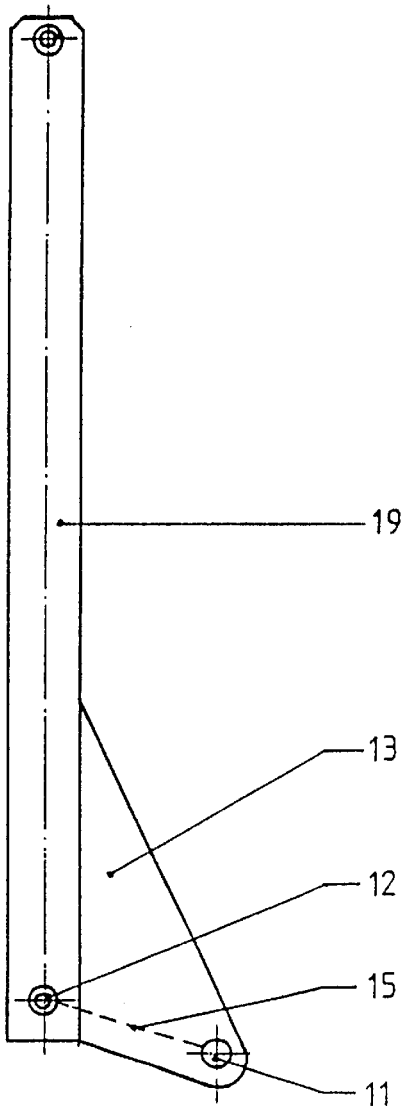
Fig. 7.2

HYDRAULIC PLATFORM LIFT, ESPECIALLY FOR MOTORCYCLES

BACKGROUND OF THE INVENTION

The present invention relates to a hydraulic platform lift, in particular a motorcycle platform lift, comprising a parallelogram chassis, in which on one of the two parallel lifting arms a hydraulic cylinder, supported on the sub-frame, engages the one lifting arm at an articulation point on a projection directedly downwardly therefrom to beneath the pivot axis of the one lifting arm on the sub-frame, in order to make available a favorable lever arm between the articulation point and the pivot axis of the one lifting arm for the force transmission of the hydraulic cylinder.

A platform lift known from prior art is depicted in FIGS. 2.1 to 2.3. The pressure force of the hydraulic cylinder which, in platform lifts of the above-described type, can be up to approximately 3 t, is here completely shunted into the sub-frame. This sub-frame as well as also the particular lifting arm must be dimensioned correspondingly thick in order to be able to absorb these forces. This leads to an unfavorable intrinsic weight/lifting-force ratio which is the reason why these lifts as a rule are reserved as stationary equipment for workplaces.

Furthermore, a factor affecting the intrinsic weight/lifting-force ratio disadvantageously is that the second lifting arm is pulled by the lifting arm acted upon by the hydraulic cylinder over the top-frame. This construction would by necessity lead to jamming of the parallelogram chassis with large loads to be lifted and for reasons of reduction of the intrinsic weight thinly dimensioned structural components of the platform lift.

From EP 0 047 976 A2 and U.S. Pat. No. 2,920,773 lifting devices are known in which the hydraulic cylinder supported on the sub-frame engages the sub-frame at an articulation point beneath the pivot axis of the one lifting arm on the sub-frame. For this purpose, this lifting arm comprises in this region a projection directed downwardly. Through this projection a very favorable lever arm for the transmission of the lifting force of the hydraulic cylinder onto the lifting arm is given.

Known platform lifts of the type under consideration here therefore for the reasons listed above have an intrinsic weight between approximately 140 to more than 200 kg with the lifting capability being approximately 400 kg.

SUMMARY OF THE INVENTION

It is the task of the present invention to provide a hydraulic platform lift, in particular a motorcycle platform lift, of the above-described type which has a substantially better intrinsic weight/lifting-force ratio than the comparable platform lifts known from prior art.

This task is solved according to the invention by means of a platform lift a tie member connecting the support point of the hydraulic cylinder on the sub-frame with the lifting arm is provided whose articulation point on the lifting arm is coaxial with its pivot axis.

In order to relieve the source-point of the lifting force of the hydraulic cylinder in the sub-frame, and to permit a deflection from horizontal into vertical motion, according to the invention the tie member from the line of the pivot axis of the lifting arm to the source of the lifting force on the cylinder base is provided. The superposition of these points, i.e. the absorption of the cylinder base in the sub-frame and the end point of the tie member cause the lifting force to experience a deflection about the pivot axis through equivalent tension force. In this configuration of the elements the lifting force of the cylinder is neutralized such that the sub-frame which substantially only must absorb the forces of the load to be lifted and can thus be dimensioned correspondingly thin. Therewith an intrinsic weight/lifting-force ratio of up to approximately ⅙ is possible.

BRIEF DESCRIPTION OF THE DRAWINGS

In the following detailed description, reference will be made to the attached drawings in which:

FIG. 2.1 is a side elevational view of a prior art platform lift shown in a descended state.

FIG. 2.2 is a side elevational view of the prior art platform lift of FIG. 2.1 but shown in an extended state.

FIG. 2.3 is a line diagram of a hydraulic cylinder and one of the lifting arms of the prior art platform lift of FIGS. 2.1 and 2.2 showing their respective directions of movement.

FIG. 6.1 is a top plan view of the first lifting arm of the platform lift of FIG. 1.

FIG. 6.2 is a side elevational view of the first lifting arm of FIG. 6.1.

FIG. 7.1 is a top plan view of the second lifting arm of the platform lift of FIG. 1.

FIG. 7.2 is a side elevational view of the second lifting arm of FIG. 7.1.

DETAILED DESCRIPTION OF THE PREFERRED EMBODIMENTS

Figure 1:
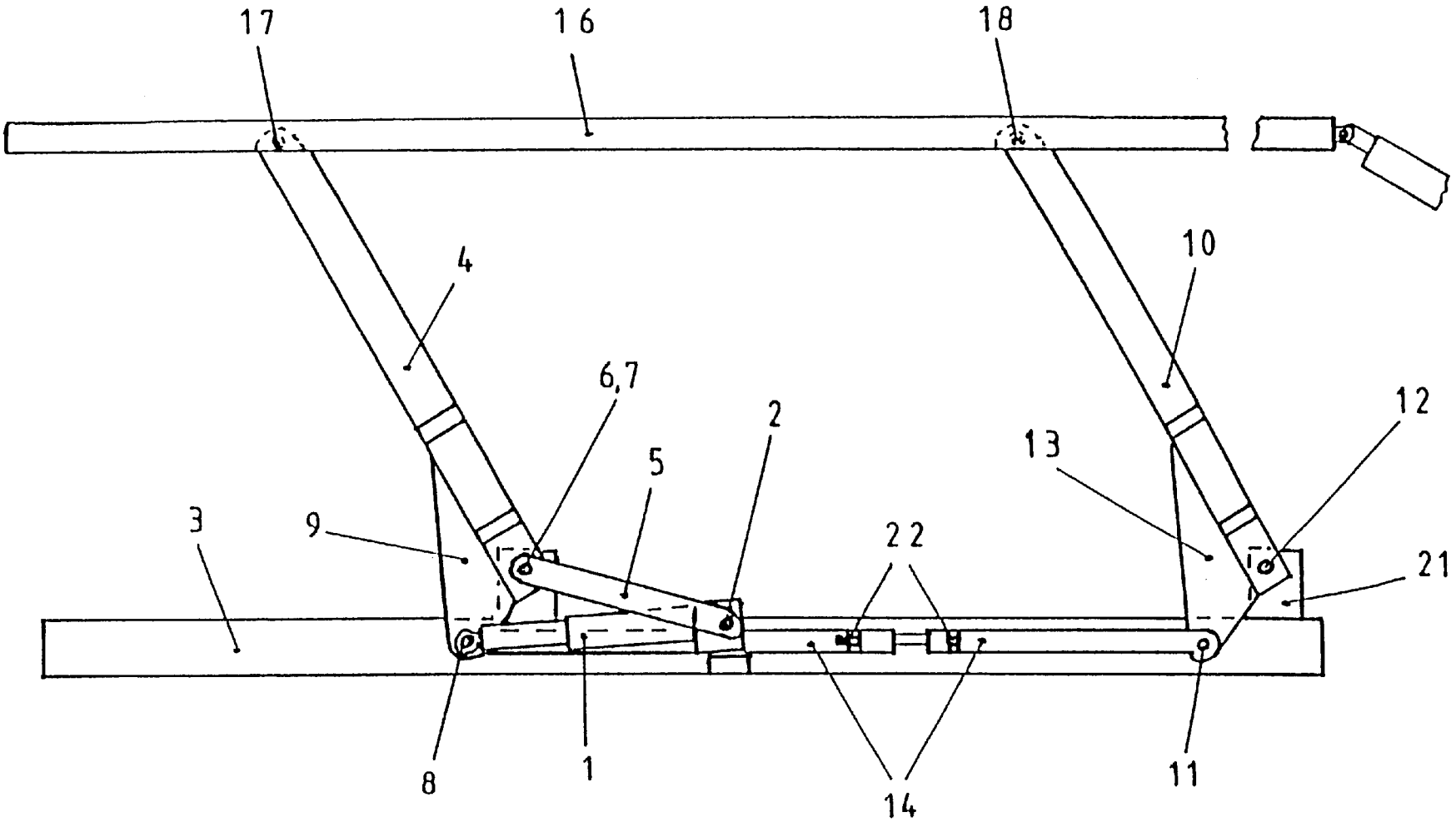
FIG. 1 is a side elevational view of a platform lift of the present invention shown in an extended state.

Like known platform lifts, the platform lift according to the invention as illustrated in FIG. 1, comprises a sub-frame 3, a top-frame 16 and first and second parallel lifting arms 4 and 10 which are pivotally articulated in points 7 and 17 and 12 and 18, respectively, on the sub-frame 3 and the top-frame 16, respectively.

The construction of the lifting arms 4 and 10 is best shown respectively in FIGS. 6.1, 6.2 and 7.1, 7.2. Each of the first and second lifting arms have two longitudinal members 19 laterally spaced apart and extending generally parallel to one another and being rigidly connected one with the other by two transverse members 20. At each end of the longitudinal members are provided bearing eyes 7, 17 or 12, 18, respectively, for receiving the associated pivot axles.

Rigidly connected with the transverse member 20 of the first lifting arm 4 is a first projection in the form of a pair of lifting plates 9 which project downwardly, which is particularly evident in FIGS. 1 and 6.2. Approximately at the lowest point of this projection a bearing bolt 8 is provided which penetrates both lifting plates 9 of the first projection. Above this bolt 8 are provided on the lifting plates 9 further bearing bolts 6 coaxially with the bearing eyes 7.

Centrally onto the transverse member 20 of the first lifting arm 10 is welded a second projection in the form of a plate 13 which also projects downwardly, and is penetrated approximately at the lowest point by a bearing bolt 11. The spacing 15 between the bearing bolt 11 and an imaginary line between the bearing eyes 12, is equal to the spacing 15 between the bearing bolt 8 and an imaginary line between the bearing eyes 7.

U-shaped bearing blocks 21 are welded onto the sub-frame 3, which between their side-pieces receive the longitudinal members 19 of the first and second lifting arms 4 and 10. The articulation of the first and second lifting arms 4, 10 takes place through pivot axles which are inserted through the bearing eyes 7 respectively 12 and bores provided correspondingly in the side-pieces of the bearing blocks 21.

The hydraulic cylinder 1 is supported at point 2 on the sub-frame 3. At precisely this point 2 a tie member in the form of a pair of parallel extending tie bars 5 extend between and pivotally connect with the point 2 on the sub-frame 3 and the bearing bolts 6 at the two plates 9 of the first projection on the first lifting arm 4. The connecting rod eye of the lifting cylinder piston is seated between the plates 9 of the first projection and on the bearing bolt 8.

On the bearing bolt 8 are also supported the ends of a pull rod 14. This pull rod 14 comprises (not shown in the Figures) two parallel struts. The ends of these two struts are outside in contact with the plates 9 of the first projection on the first lifting arm 4.

Figure 3:
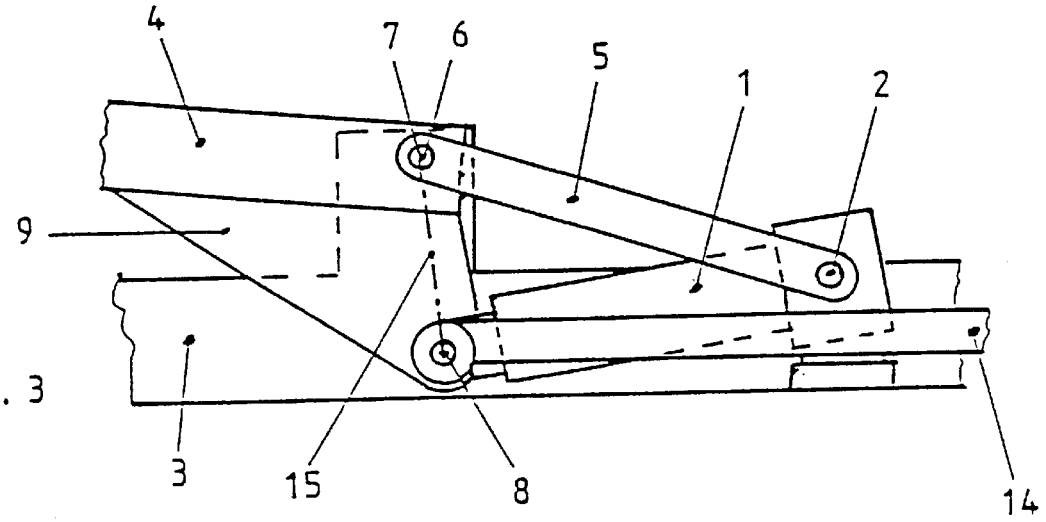
FIG. 3 is an enlarged fragmentary view of the platform lift of FIG. 1, showing the articulation relationship between a first lifting arm pivotally connected on a sub-frame, a first projection on the first lifting arm, a hydraulic cylinder pivotally connected between the first projection and the sub-frame, a tie member pivotally connected between the support point of the hydraulic cylinder on the sub-frame and the pivot axis of the first lifting arm and a pull member pivotally connected between first and second projections on the first and second lifting arms.
Figure 4:
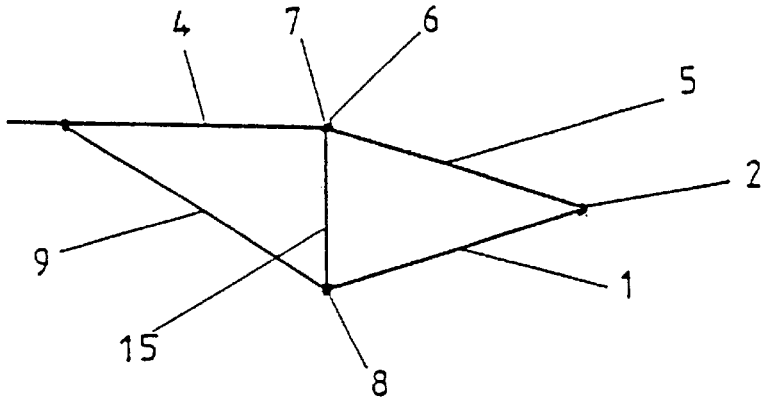
FIG. 4 is a diagram of the articulation relationship of FIG. 3.
Figure 5:
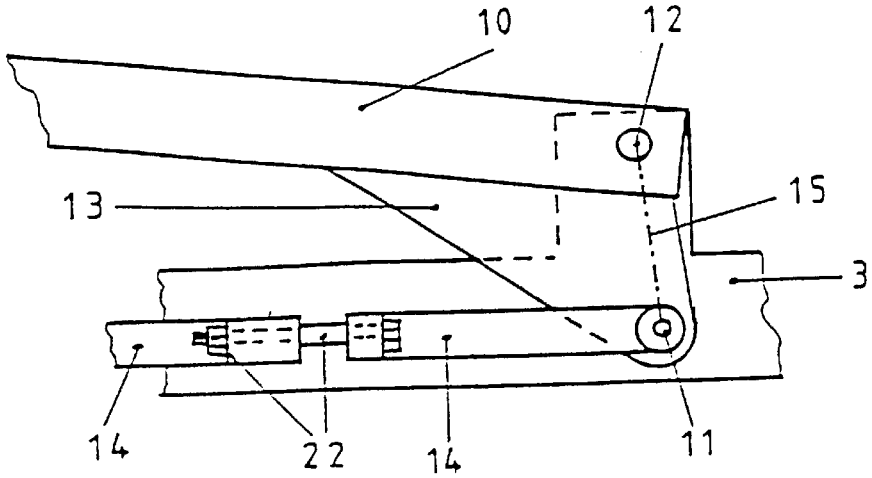
FIG. 5 is an enlarged fragmentary view of the platform lift of FIG. 1, showing the articulation relationship between the second lifting arm and sub-frame and the pull member pivotally connected between the first and second projections on the first and second lifting arms.

As seen in FIGS. 1, 3 and 5, the pull rod 14 is divided into two longitudinal segments with both of these longitudinal segments being connected by an adjustable bolt-nut configuration 22. The longitudinal segment, leading to the second arm 10, of the pull rod 14 is articulated on the plate 13 of the second projection on the second lifting arm 10 via the bearing bolt 11. The ends of the two struts are in contact on the left and right of the plate 13, thus the spacing of the struts of the pull rod 14 in this longitudinal segment is less than that of the struts in the other longitudinal segment of the pull rod 14.

Via the adjustable bolt-nut configuration 22 of the pull rod 14 through appropriately strong tightening of the nut prestress between the first and second lifting arms 4 and 10 can be produced. This ensures that the two lifting arms 4, 10 move completely in parallel even with relatively large loads.

The hydraulic cylinder 1 has approximately a lifting force of 2.7 t. In the platform lift according to the invention this is not transferred into the sub-frame 3 but rather shunted via the tie bars 5 onto the plates 9 of the first projection on the first lifting arm 4. The loading of the structural components of the platform lift through the hydraulic cylinder is thus practically neutralized. As a consequence, a platform lift according to the invention can be built to be very light. In a test, 760 kg can be lifted without problems at an intrinsic weight of the platform lift of 82 kg.

I claim:

1. A hydraulic platform lift, comprising:

(a) a parallelogram chassis including a sub-frame, a top-frame and first and second lifting arms displaced from one another along and extending between said sub-frame and top-frame in a generally parallel relationship to one another, each of said first and second lifting arms having a pair of opposite ends pivotally coupled about respective pivot axes to said sub-frame and top-frame so as to support said top-frame above said sub-frame and in a generally parallel relationship therewith for undergoing movement toward and away from said sub-frame between retracted and extended positions relative to said sub-frame;

(b) a first projection attached respectively on said first lifting arm adjacent to the one of said opposite ends thereof at which said first lifting arm is pivotally coupled to said sub-frame, said first projection projecting from said one opposite end of said first lifting arm and having a first articulation point spaced from and a second articulation point coaxial with said pivot axis about which said one opposite end of said first lifting arm is coupled to said sub-frame;

(c) a hydraulic cylinder having a pair of opposite ends being movable relative to one another toward and away from one another, one of said opposite ends of said hydraulic cylinder being pivotally connected to said sub-frame at a stationary pivot axis thereon, the other of said opposite ends of said hydraulic cylinder being pivotally connected to said first projection on said first lifting arm at said first articulation point thereon such that relative movement of said opposite ends of said hydraulic cylinder toward and away from one another causes pivotal movement of said first and second lifting arms relative to said sub-frame and top-frame and movement of said top-frame between said extended and retracted positions relative to said sub-frame; and (d) a tie member having a pair of opposite ends and extending between and pivotally connected at one of said opposite ends of said tie member to said sub-frame at said stationary pivot axis of said hydraulic cylinder with said sub-frame and at the other of said opposite ends of said tie member with one of said first lifting arm at said pivot axis of said one end thereof and said first projection at said second articulation point thereon such that a lifting force produced by said hydraulic cylinder is not transferred to said sub-frame but instead is shunted via said tie member onto said first projection on said first lifting arm whereby loading of said sub-frame via said hydraulic cylinder is substantially neutralized.

2. The lift of claim 1 wherein said first lifting arm includes a pair of longitudinal members and a pair of cross members spaced from one another along said longitudinal members and extending in a generally transverse relationship between and rigidly connected with said longitudinal members so as to disposed said longitudinal members in a generally parallel relationship to one another.

3. The lift of claim 2 wherein said first projection includes a pair of spaced apart plates rigidly connected to said cross members of said first lifting arm and projecting therefrom and first and second bearing members extending between and coupled to said plates at said respective first and second articulation points thereon.

4. The lift of claim 3 wherein said tie member is a pair of tie bars extending in a generally parallel relationship with one another.

5. The lift of claim 1 further comprising:

a second projection projecting substantially identically from said one of said opposite ends of said second lifting arm as said first projection projects from said one of said opposite ends of said first lifting arm, said second projection having a first articulation point thereon corresponding to said first articulation point on said first projection of said first lifting arm.

6. The lift of claim 5 wherein said second lifting arm includes a pair of longitudinal members and a pair of cross members spaced from one another along said longitudinal members and extending in a generally transverse relationship between and rigidly connected with said longitudinal members so as to disposed said longitudinal members in a generally parallel relationship to one another.

7. The lift of claim 6 wherein said second projection includes a plate rigidly connected to said cross members of said second lifting arm and projecting therefrom and a third bearing member coupled to said plate at said first articulation point on said plate.

8. The lift of claim 7 further comprising:

an elongated pull member having a pair of opposite ends and extending between and connected at said opposite ends to said first articulation points on said first and second projections of said first and second lifting arms; and means on said pull member for providing prestress on said first and second lifting arms so as to ensure that said first and second lifting arms pivotally move in said generally parallel relationship with one another.

9. The lift of claim 8 wherein:

said pull member includes a pair of longitudinal segments generally aligned with one another; and said prestress providing means is a fastener disposed between and interconnecting said longitudinal segments and being adjustable by tightening so as to provide said prestress on said first and second lifting arms.

10. A hydraulic platform lift, comprising:

(a) a parallelogram chassis including a sub-frame, a top-frame and first and second lifting arms displaced from one another along and extending between said sub-frame and top-frame in a generally parallel relationship to one another, each of said lifting arms having a pair of opposite ends pivotally coupled about respective pivot axes to said sub-frame and top-frame so as to support said top-frame above said sub-frame and in a generally parallel relationship therewith for undergoing movement toward and away from said sub-frame between retracted and extended positions relative to said sub-frame;

(b) first and second projections attached respectively on said first and second lifting arms adjacent to the ones of said opposite ends thereof at which said lifting arms are pivotally coupled to said sub-frame, said first and second projections projecting substantially identically away from said ones of said opposite ends of said first and second lifting arms and having respective first articulation points thereon spaced at substantially identical distances from respective ones of said pivot axes about which said one ends of said lifting arms are coupled to said sub-frame;

(c) a hydraulic cylinder having a pair of opposite ends movable toward and away from one another, one of said opposite ends of said hydraulic cylinder being pivotally connected to said sub-frame at a stationary location therealong, the other of said opposite ends of said hydraulic cylinder being piovotally connected to said first projection on said first lifting arm at said first articulation point thereon such that movement of said opposite ends of said hydraulic cylinder toward and away from one another causes pivotal movement of said first and second lifting arms relative to said sub-frame and top-frame and movement of said top-frame between said extended and retracted positions relative to said sub-frame; and (d) an elongated pull member having a pair of opposite ends and extending between and connected at said opposite ends to said first articulation points on said first and second projections of said first and second lifting arms; and (e) means on said pull member for providing prestress on said first and second lifting arms so as to ensure that said first and second lifting arms pivotally move in said generally parallel relationship with one another.

11. The lift of claim 10 wherein:

said pull member includes a pair of longitudinal segments generally aligned with one another; and said prestress providing means is a fastener disposed between and interconnecting said longitudinal segments and being adjustable by tightening so as to provide said prestress on said first and second lifting arms.

12. The lift of claim 10 wherein said first lifting arm includes a pair of longitudinal members and a pair of cross members spaced from one another along said longitudinal members and extending in a generally transverse relationship between and rigidly connected with said longitudinal members so as to disposed said longitudinal members in a generally parallel relationship to one another.

13. The lift of claim 12 wherein said first projection includes a pair of spaced apart plates rigidly connected to said cross members of said first lifting arm and projecting therefrom and a first bearing member coupled to said plates at said first articulation point thereon.

14. The lift of claim 12 wherein said second lifting arm includes a pair of longitudinal members and a pair of cross members spaced from one another along said longitudinal members and extending in a generally transverse relationship between and rigidly connected with said longitudinal members so as to disposed said longitudinal members in a generally parallel relationship to one another.

15. The lift of claim 14 wherein said second projection includes a plate rigidly connected to said cross members of said second lifting arm and projecting therefrom and a third bearing member coupled to said plate at said first articulation point on said plate.

16. The lift of claim 15 wherein:

said pull member includes a pair of longitudinal segments generally aligned with one another, one of said longitudinal segments at one of said opposite ends of said pull member being pivotally connected to said first articulation point defined by said bearing member of said first projection on said first lifting arm, the other of said longitudinal segments at the other of said opposite ends of said pull member being pivotally connected to said first articulation point defined by said bearing member of said second projection on said second lifting arm; and said prestress providing means is a fastener disposed between and interconnecting said longitudinal segments and being adjustable by tightening so as to provide said prestress on said first and second lifting arms.

* * * * *